US010022835B2

(12) United States Patent
Feng et al.

(10) Patent No.: US 10,022,835 B2
(45) Date of Patent: Jul. 17, 2018

(54) POLISHING PAD, POLISHING APPARATUS AND METHOD FOR MANUFACTURING POLISHING PAD

(71) Applicant: San Fang Chemical Industry Co., Ltd., Kaohsiung (TW)

(72) Inventors: Chung-Chih Feng, Kaohsiung (TW); I-Peng Yao, Kaohsiung (TW); Yung-Chang Hung, Kaohsiung (TW); Wei-Te Liu, Kaohsiung (TW)

(73) Assignee: San Fang Chemical Industry Co., Ltd., Kaohsiung (TW)

( * ) Notice: Subject to any disclaimer, the term of this patent is extended or adjusted under 35 U.S.C. 154(b) by 0 days.

(21) Appl. No.: 15/849,313

(22) Filed: Dec. 20, 2017

(65) Prior Publication Data

US 2018/0111247 A1 Apr. 26, 2018

Related U.S. Application Data

(62) Division of application No. 14/597,656, filed on Jan. 15, 2015.

(30) Foreign Application Priority Data

Jan. 17, 2014 (TW) ..... 103101862 A

(51) Int. Cl.
*B24B 37/22* (2012.01)
*B24B 37/24* (2012.01)

(52) U.S. Cl.
CPC ..... *B24B 37/22* (2013.01); *B24B 37/24* (2013.01)

(58) Field of Classification Search
CPC ..... B24B 37/22; B24B 37/24; B24D 18/0027; B24D 3/28
See application file for complete search history.

(56) References Cited

U.S. PATENT DOCUMENTS 2,703,128 A * 3/1955 Darrow ..... B60C 9/09 152/557
4,093,763 A * 6/1978 Hartmann ..... D04H 3/009 427/377
4,728,552 A * 3/1988 Jensen, Jr. ..... B24B 37/24 101/376
4,735,849 A * 4/1988 Murakami ..... D04H 3/10 28/104
4,841,684 A * 6/1989 Hall, Jr. ..... B24D 11/00 156/148
6,479,413 B1 * 11/2002 Booher ..... F16D 69/026 442/101
2005/0020171 A1 * 1/2005 Yoshida ..... B01D 39/163 442/327
2008/0171493 A1 * 7/2008 Feng ..... B24B 37/20 451/59
2009/0047877 A1 * 2/2009 Muldowney ..... B24B 37/22 451/59
2010/0146863 A1 * 6/2010 Feng ..... B24B 37/22 51/296

(Continued)

*Primary Examiner* — Marc Carlson
(74) *Attorney, Agent, or Firm* — WPAT, P.C., Intellectual Property Attorneys; Anthony King

(57) ABSTRACT

The present invention relates to a polishing pad comprising a buffer sheet containing a pressure distribution sheet. The invention also relates to a polishing apparatus and a method for manufacturing a polishing pad.

12 Claims, 7 Drawing Sheets

(56) References Cited

U.S. PATENT DOCUMENTS

| | | | | |
|---|---|---|---|---|
| 2011/0045744 | A1* | 2/2011 | Feng | B24B 37/22<br>451/41 |
| 2013/0331014 | A1* | 12/2013 | Shiro | B24B 37/24<br>451/532 |

* cited by examiner

POLISHING PAD, POLISHING APPARATUS AND METHOD FOR MANUFACTURING POLISHING PAD

BACKGROUND OF THE INVENTION

1. Field of the Invention

The present invention relates to a polishing pad, a polishing apparatus and a method for manufacturing a polishing pad.

2. Description of the Related Art

Polishing generally refers to a wear control for a preliminary coarse surface in a process of chemical mechanical polishing (CMP), which makes the slurry containing fine particles evenly dispersed on the upper surface of a polishing pad, and at the same time places a substrate against the polishing pad and then rubs the substrate repeatedly with a regular motion. The substrate may be objects such as a semiconductor, a storage medium substrate, an integrated circuit, an LCD flat-panel glass, an optical glass and a photoelectric panel. During the polishing process, a mounting must be used for carrying and mounting the substrate, and the quality of the mounting directly influences the polishing effect of the substrate.

FIG. 1 shows a schematic view of a polishing apparatus with a conventional polishing pad. The polishing apparatus 1 includes a lower base plate 11, a mounting 12, a substrate 13, an upper base plate 14, a polishing pad 15 and slurry 16. The lower base plate 11 is positioned opposite to the upper base plate 14. The mounting 12 is adhered to the lower base plate 11 through an adhesive layer and is used for carrying and mounting the substrate 13. The polishing pad 15 is mounted on the upper base plate 14, and faces to the lower base plate 11 for polishing the substrate 13.

The operation mode of the polishing apparatus 1 is as follows. First, the substrate 13 is mounted on the mounting 12, and then both the upper and lower base plates 14 and 11 are rotated and the lower base plate 11 is simultaneously moved downward, such that the polishing pad 15 contacts the surface of the substrate 13, and a polishing operation for the substrate 13 may be performed by continuously supplementing the slurry 16 and using the effect of the polishing pad 15.

When polishing, the polishing pad 15 simultaneously withstands the pressure of the lower base plate 11 and upper base plate 14 from different ways. In order to avoid scraping the substrate 13, the polishing pad 15 usually comprises a polishing sheet and a buffer sheet. Depending on the substrate 13, the material of the polishing pad can be a non-woven fabric, an elastomer, or a mixture thereof. Most of the materials of the buffer sheet are a non-woven fabric as a main body. When the buffer sheet contains the non-woven fabric, it has better compression rate and recovery rate than the polishing sheet. Wherein, the compression rate can increase the adaptation between the polishing sheet and the substrate, and the recovery rate can increase the life span of the polishing pad.

However, in the manufacture of the non-woven fabric, control of the thickness uniformity is not easy, so using the buffer sheet with the non-woven fabric as the main body may often cause many problems due to the non-uniform thickness. For example, when the polishing pad withstands the pressure, the non-uniform thickness of the non-woven fabric causes the diversity of the density in different areas of the buffer sheet and yields the diversity of the compression rate. The area where the compression rate is smaller or the thickness is thicker may lead the friction between the polishing pad and the substrate to become bigger, and the polishing pad also wears faster. Due to the difference of the wear degree, a surface of the polishing pad becomes more uneven that causes unstable polishing surface removal rate of the substrate and poor flatness, and forms a defective product finally.

Therefore, a novel polishing pad in the field is needed to be developed to overcome the defect of the aforementioned non-uniform pressure of the non-woven fabric in the buffer sheet and to improve the polishing effect.

SUMMARY OF THE INVENTION

The present invention is to add a buffer sheet having a pressure distribution sheet in a polishing pad to obtain the buffer sheet with uniform thickness and attached amount. When the polishing pad withstands the pressure, the buffer sheet can spread the pressure uniformly and provide a uniform buffer force to the polishing pad. Therefore, the friction between the polishing pad and a substrate is also uniform, and it can increase the flatness of a surface of the substrate, and it can prevent the indentation and deformation of the polishing pad.

The invention provides a polishing pad comprising a polishing sheet and a buffer sheet, wherein the buffer sheet comprises:

- a main body comprising a plurality of first non-oriented fibers; and
- a pressure distribution sheet comprising a plurality of first oriented fibers and a plurality of second oriented fibers, wherein all the first oriented fibers are arranged in a first direction; all the second oriented fibers are arranged in a second direction; the first direction intersects with the second direction; and the first oriented fibers and/or the second oriented fibers intersect with at least one of the first non-oriented fibers.

The invention also provides a polishing apparatus comprising:

- a base plate;
- a substrate;
- the polishing pad mentioned above, which is adhered on the base plate for polishing the substrate; and
- a polishing slurry, which is contacting with the substrate for polishing.

The invention further provides a method for manufacturing the aforementioned polishing pad, wherein the buffer sheet is provided by a process comprising:

(a) providing a main body comprising a plurality of first non-oriented fibers;

(b) providing a plurality of first oriented fibers and a plurality of second oriented fibers, wherein all the first oriented fibers are arranged in a first direction; all the second oriented fibers are arranged in a second direction; the first direction intersects with the second direction; and the first oriented fibers and/or the second oriented fibers intersect with at least one of the first non-oriented fibers; and (c) forming a pressure distribution sheet, wherein the first oriented fibers and/or the second oriented fibers intersect with at least one of the second non-oriented fibers.

DETAILED DESCRIPTION OF THE INVENTION

Figure 8:
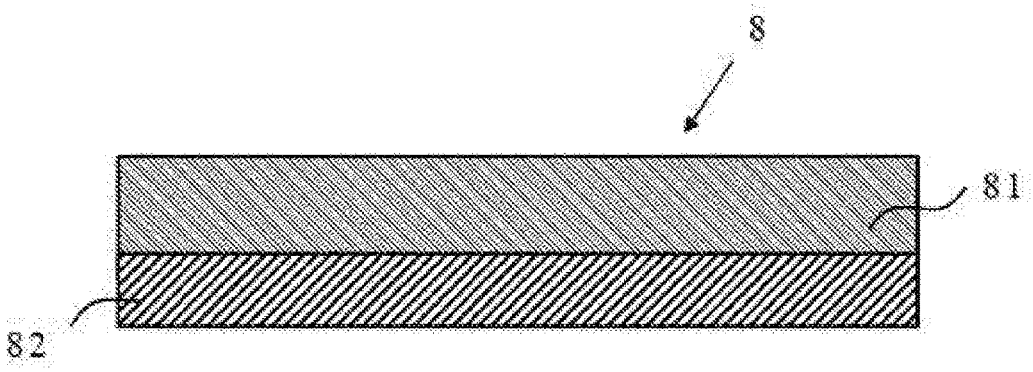
FIG. 8 shows a sectional view of a polishing pad according to one embodiment of the invention.

The invention provides a polishing pad 8 (as shown in FIG. 8) comprising a polishing sheet 81 and a buffer sheet 82, wherein the buffer sheet comprises:

a main body comprising a plurality of first non-oriented fibers; and a pressure distribution sheet comprising a plurality of first oriented fibers and a plurality of second oriented fibers, wherein all the first oriented fibers are arranged in a first direction; all the second oriented fibers are arranged in a second direction; the first direction intersects with the second direction; and the first oriented fibers and/or the second oriented fibers intersect with at least one of the first non-oriented fibers.

The term "polishing pad" as used herein refers to a pad for planarizing a substrate in a process of chemical mechanical polishing, which is used against a substrate; wherein the polishing pad repeats the action regularly to polish the substrate and coordinates with the slurry having fine particles for wearing the coarse surface of the substrate until smooth.

The polishing sheet according to the invention is a portion in the polishing pad which is used to wear the substrate. Depending on the substrate, the material of the polishing sheet may be a non-woven fabric, an elastomer, or a mixture thereof.

The term "a non-woven fabric" as used herein refers to a manufactured sheet, web or mat of directionally or randomly orientated fibers, bonded by friction, and/or cohesion and/or adhesion, excluding paper and products which are woven, knitted, tufted, stitch-bonded incorporating binding yarns or filaments, or felted by wet-milling, whether or not additionally needled. The fibers may be of natural or man-made origin. They may be staple or continuous filaments or be formed in situ. Depending on the method of forming the web, the nonwoven fabric usually comprises a composite nonwoven fabric, a needle-punched nonwoven fabric, a melt-blown nonwoven fabric, a spun bonded nonwoven fabric, a dry-laid nonwoven fabric, a wet-laid nonwoven fabric, a stitch-bonded nonwoven fabric, or a spun lace nonwoven fabric. Compared with a woven fabric, a non-woven fabric has a better material property.

As used herein, the term "an elastomer," refers to a type of polymer that exhibits rubber-like qualities. When polishing, the elastomer serves as a good buffer to avoid scraping a surface of the substrate to be polished. Preferably, the elastomer comprises a foaming resin. As used herein, the term "foaming resin" refers to a material containing a thermoplastic resin and a thermodecomposing foaming agent. Preferably, the resin comprises at least one selected from the group consisting of polyurethane, polyolefin, polycarbonate, polyvinyl alcohol, nylon, elastic rubber, polystyrene, poly aromatic molecules, fluorine-containing polymer, polyimide, cross-linked polyurethane, cross-linked polyolefin, polyether, polyester, polyacrylate, elastic polyethylene, polytetrafluoroethene, poly (ethylene terephthalate), poly aromatic amide, polyarylalkene, polymethyl methacrylate, a copolymer thereof, a block copolymer thereof, a mixture thereof, and a blend thereof.

A manner of foaming the foaming resin according the invention can be chemically foaming or physically foaming; wherein the chemically foaming manner uses an agent that can carry out a chemical reaction to yield gas, and the gas after reaction is evenly distributed in the resin composition. Besides, the physically foaming manner comprises infiltrating gas into the resin composition, and the gas is evenly distributed in the resin composition by stirring.

In one preferred embodiment of the invention, the polishing sheet further comprises pores. In one embodiment of the invention, the pores are pores between non-woven fabric fibers. In one another embodiment of the invention, the pores are formed by the elastomer. In one another embodiment of the invention, the pores are formed by the elastomer and fibers. The pores can be continuous pores or independent pores. The term "continuous pores" as used herein refers to pores where at least two pores connecting to each other to form pores similar to ant nests. Preferably, the pores are continuous pores, which benefit the flow of slurry and distribution of polishing particles and removal of polishing residues. In one preferred embodiment of the invention, the continuous pores have a pore size ranging from about 0.1 μm to about 500 μm.

In one preferred embodiment of the invention, the polishing sheet further comprises a plurality of polishing particles. The polishing particles are evenly distributed in the polishing sheet. The particles can exist in the non-woven fabric or a frame formed by the elastomer, and they can also exist in pores. Preferably, the polishing particles comprise cerium dioxide, silicon dioxide, aluminum oxide, yttrium oxide, or ferric oxide. Additionally, the particle diameter of the polishing particles is from about 0.01 μm to about 10 μm.

The term "a buffer sheet" as used herein refers to a film between the polishing sheet and a polishing machine. When the polishing pad simultaneously withstands the pressure of a lower base plate and an upper base plate from different ways in polishing, the buffer sheet avoids scraping a substrate to be polished. The buffer sheet according to the invention comprises fibers.

Artisans skilled in this field can choose suitable kinds of fibers according to the disclosure of the specification. As used herein, the term "fibers" refers to single fibers or composite fibers; preferably composite fibers. Preferably, the fibers are made of at least one material selected from the group consisting of polyamide, terephthalamide, polyester, polymethyl methacrylate, polyethylene terephthalate, polyacrylonitrile, and a mixture thereof.

The buffer sheet according to the invention comprises a main body wherein comprises a plurality of first non-oriented fibers. The main body constitutes most of the buffer sheet, and a plurality of the first non-oriented fibers are bonded by friction, and/or cohesion and/or adhesion, which can be fixed-length or continuous filaments, or can be formed in sites. Preferably, the first non-oriented fibers are provided by stacking, and are formed to be an integrated structure by needle punching.

The buffer sheet according to the invention also comprises a pressure distribution sheet, which comprises a plurality of first oriented fibers and a plurality of second oriented fibers, wherein all the first oriented fibers are arranged in a first direction; all the second oriented fibers are arranged in a second direction; the first direction intersects with the second direction; and the first oriented fibers and/or the second oriented fibers intersect with at least one of the first non-oriented fibers. By providing the oriented fibers, it can further uniformly disperse the pressure from the polishing sheet to the main body of the buffer sheet, and provide buffering capacity for the polishing pad. Besides, by providing the oriented fibers, it can provide a frame in an interior region of the buffer sheet to benefit uniform thickness and attached amount of the whole buffer sheet. Therefore, the friction between the polishing pad and the substrate to be polished is more uniform which can increase the surface flatness of the substrate to prevent the indentation and deformation of the polishing pad.

The thickness of the pressure distribution sheet according to the invention can be chosen as needed; preferable, the thickness is from about 0.05 mm to about 1.0 mm. If the thickness is less than about 0.05 mm, the pressure dispersion effect is not good; if the thickness is more than about 1.0 mm, the buffer effect is also not good.

Figure 1:
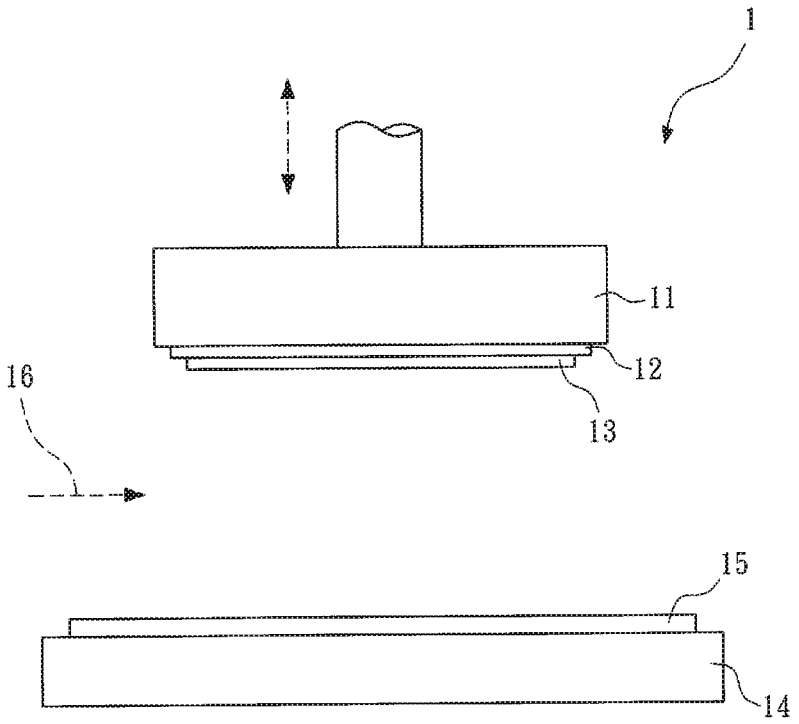
FIG 1 (Prior Art)
FIG. 1 shows a schematic view of a polishing apparatus with a conventional polishing pad.
Figure 2:
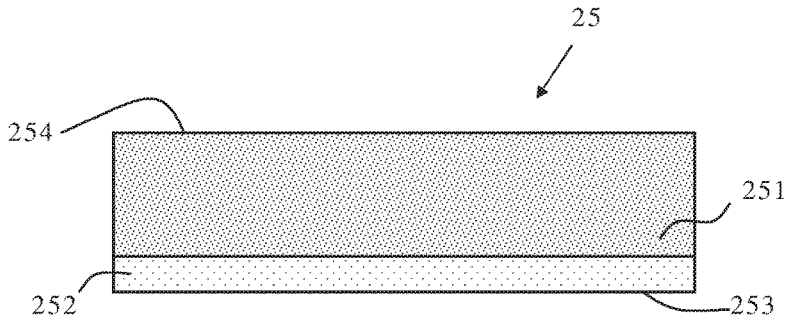
FIG. 2 shows a sectional view of a buffer sheet according to one embodiment of the invention.

FIG. 2 shows a sectional view of the buffer sheet according to the invention. In one embodiment according to the invention, a buffer sheet 25 comprises a main body 251 and a pressure distribution sheet 252. The pressure distribution sheet 252 constitutes one surface 253 of the buffer sheet 25, and the main body 251 constitutes the other surface 254 of the buffer sheet 25. In the embodiment, the main body 251 and the pressure distribution sheet 252 are a two-layered structure, and the two-layered structure is bonded by allowing the first non-oriented fibers in the main body to be intersected with the first oriented fibers and/or the second oriented fibers in the pressure distribution sheet. The bonding mode includes but is not limited to needle punching.

Figure 3:
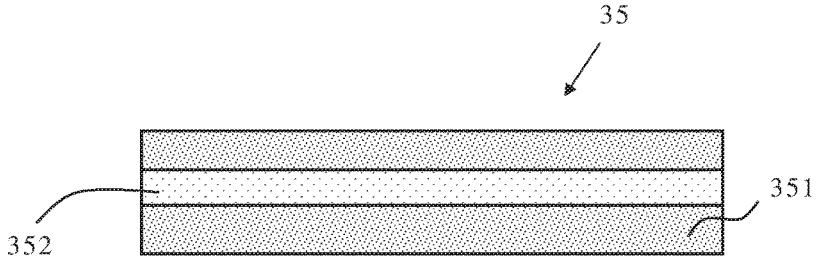
FIG. 3 shows a sectional view of a buffer sheet according to another embodiment of the invention.

FIG. 3 shows a sectional view of the buffer sheet according to the invention. In one embodiment according to the invention, the buffer sheet 35 comprises a main body 351 and a pressure distribution sheet 352. The pressure distribution sheet 352 is sandwiched into the main body 351. In the embodiment of the invention, the main body is provided by a two-layered structure, and the two-layered structure is bonded by allowing the first non-oriented fibers in the main body to be intersected with the first oriented fibers and/or the second oriented fibers in the pressure distribution sheet. The bonding mode includes but is not limited to needle punching.

Figure 4:
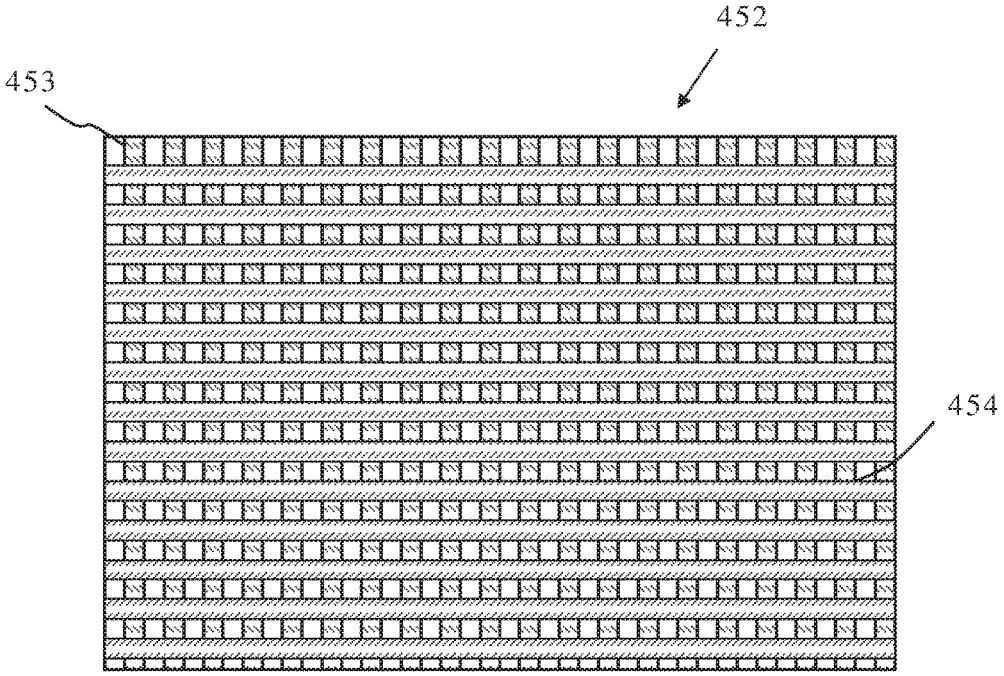
FIG. 4 shows a top view of a pressure distribution sheet according to still another embodiment of the invention.

The angle between the first direction and the second direction can be any angle according to the invention. FIG. 4 shows a top view of the pressure distribution sheet according to the invention. In one embodiment according to the invention, a pressure distribution sheet 452 comprises a plurality of first oriented fibers 453 and a plurality of second oriented fibers 454. All the first oriented fibers 453 are arranged in a first direction, and all the second oriented fibers are arranged in a second direction. The first direction is perpendicular to the second direction.

The first oriented fibers and the second oriented fibers according to the invention can be stacked or intersected with each other to form the pressure distribution sheet. Preferably, the first oriented fibers and the second oriented fibers are located on the same layer structure and woven with each other.

Figure 5:
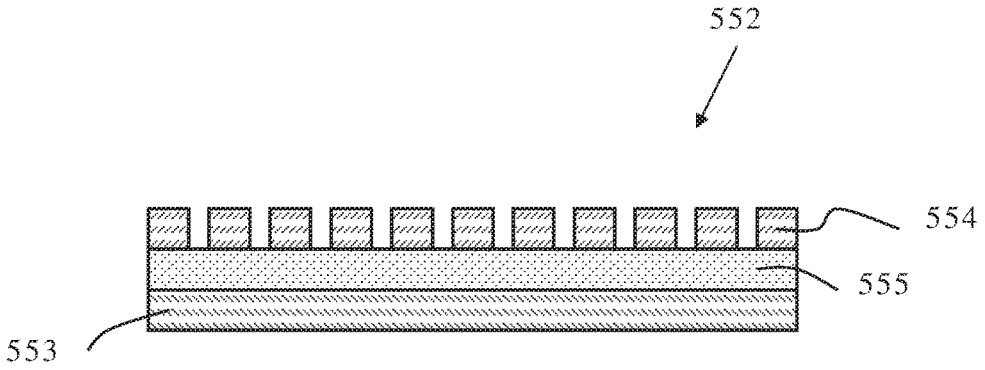
FIG. 5 shows a sectional view of a pressure distribution sheet according to still another embodiment of the invention.

FIG. 5 shows a sectional view of the pressure distribution sheet according to the invention. In one embodiment according to the invention, a pressure distribution sheet 552 comprises a plurality of first oriented fibers 553 and a plurality of second oriented fibers 554. The first oriented fibers 553 are located on a first plane, and the second oriented fibers 554 are located on a second plane. The pressure distribution sheet further comprises a plurality of second non-oriented fibers 555 between the first plane and the second plane, and the first oriented fibers 553 and/or the second oriented fibers 554 intersects with at least one of the second non-oriented fibers 555. In this embodiment, although the first direction of the first oriented fibers 553 are located on the first plane, and the second direction of the second oriented fibers 554 are located on the second plane, the perpendicular projection of the first direction still intersects with the second direction. The pressure distribution sheet with a multi-layered structure can disperse the pressure of the buffer sheet multileveled and benefits more uniform thickness and attached amount of fibers.

The formation of the second non-oriented fibers is similar to that of the first non-oriented fibers. Preferably, the second non-oriented fibers and the first non-oriented fibers are the same.

Figure 6:
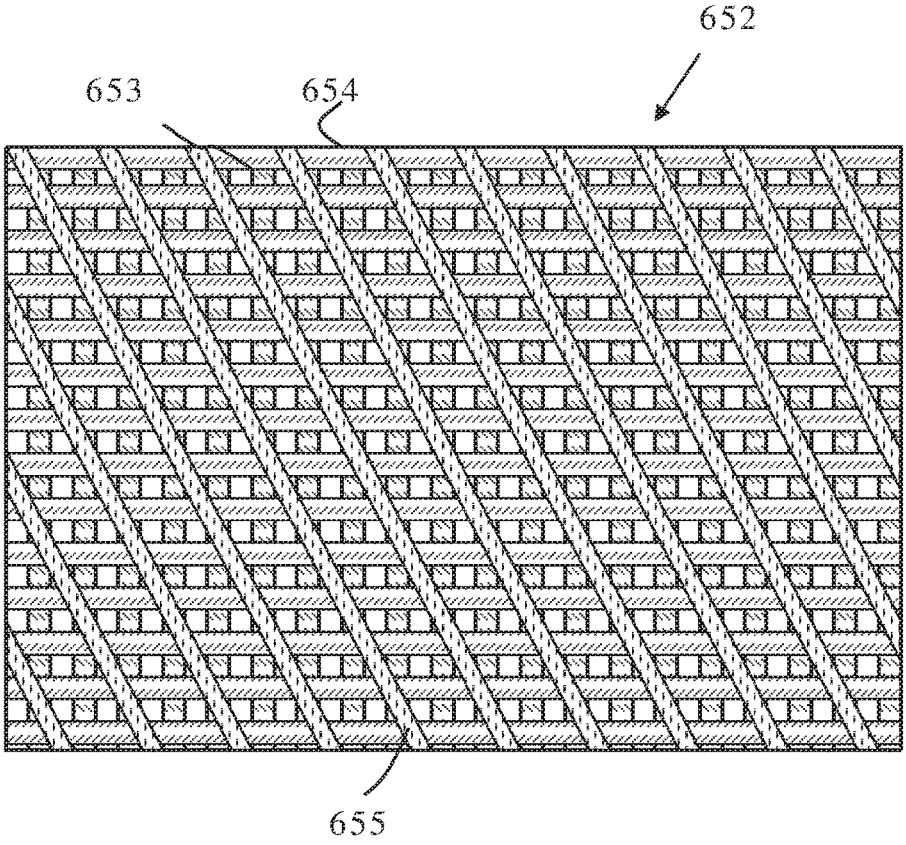
FIG. 6 shows a top view of a pressure distribution sheet according to still another embodiment of the invention.

FIG. 6 shows a top view of the pressure distribution sheet according to the invention. In one embodiment according to the invention, a pressure distribution sheet 652 comprises a plurality of first oriented fibers 653, a plurality of second oriented fibers 654, and further a plurality of third oriented fibers 655. All the third oriented fibers 655 are arranged in a third direction, and the third oriented fibers 655 intersect with the first oriented fibers 653 and/or the second oriented fibers 654. In the embodiment, besides the first oriented fibers 653 and the second oriented fibers 654; the pressure distribution sheet 652 can also comprise other oriented fibers, such as the third oriented fibers 655.

Preferably, the oriented fibers according to the invention are long-fiber, which can increase the effect of pressure distribution. More preferably, as shown in FIG. 4 or FIG. 6, each of the first oriented fibers 453, 653 and/or each of the second oriented fibers 454, 654 runs through the buffer sheet.

The material of the oriented fibers and the material of the non-oriented fibers can be the same or different. Preferably, the material of the first non-oriented fibers is different from that of the first oriented fibers and/or the second oriented fibers. In one embodiment according to the invention, the materials of the oriented fibers have high tenacity and not easy to break off. The materials of the non-oriented fibers are high soft and good flexible.

Preferably, the buffer sheet is provided by roll-to roll, which can improve batch uniformity.

The invention also provides a polishing apparatus, wherein the polishing apparatus comprising:

- a base plate;
- a substrate;
- a polishing pad, which is adhered on the base plate for polishing the substrate; and
- a polishing slurry, which is contacting with the substrate for polishing.

Preferably, the polishing apparatus further comprising:

- a lower base plate which is positioned opposite to the base plate; and
- a mounting sheet which is adhered to the lower base plate for carrying and mounting the substrate.

Figure 7:
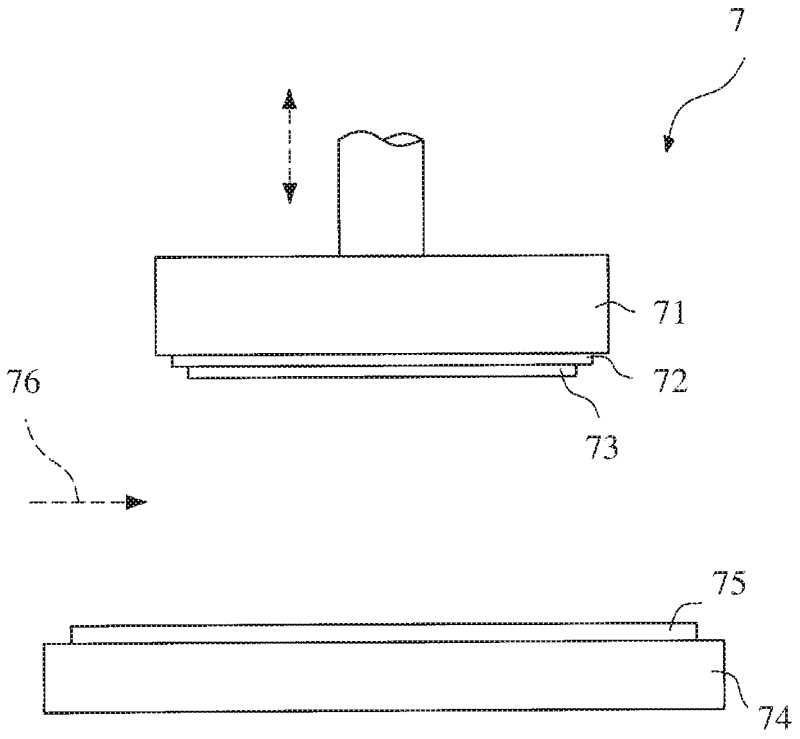
FIG. 7 shows a schematic view of a polishing apparatus with a polishing pad according to the present invention.

FIG. 7 shows a schematic view of a polishing apparatus according to the polishing pad of the invention. The polishing apparatus 7 includes a lower base plate 71, a mounting sheet 72, a substrate 73, an upper base plate 74, a polishing pad 75 and slurry 76. The lower base plate 71 is positioned opposite to the upper base plate 74. The mounting sheet 72 is adhered to the lower base plate 71 through an adhesive layer (not shown) and is used for carrying and mounting the substrate 73. The polishing pad 75 is mounted on the upper base plate 74, and faces to the lower base plate 71 for polishing the substrate 73.

The operation mode of the polishing apparatus 7 is as follows. First, the substrate 73 is mounted on the mounting sheet 72, and then both the upper and lower base plates 74 and 71 are rotated and the lower base plate 71 is simultaneously moved downward, such that the polishing pad 75 contacts the surface of the substrate 73, and the substrate 73 may be performed by continuously supplementing the slurry 76 and using the effect of the polishing pad 75.

The invention further provides a method for manufacturing the aforementioned polishing pad, wherein the buffer sheet is provided by a process comprising:

(a) providing a main body comprising a plurality of first non-oriented fibers;

(b) providing a plurality of first oriented fibers and a plurality of second oriented fibers, wherein all the first oriented fibers are arranged in a first direction; all the second oriented fibers are arranged in a second direction; the first direction intersects with the second direction; and the first oriented fibers and/or the second oriented fibers intersect with at least one of the first non-oriented fibers; and (c) forming a pressure distribution sheet, wherein the first oriented fibers and/or the second oriented fibers intersect with at least one of the second non-oriented fibers.

Because the main body constitutes most of the buffer sheet, a plurality of the first non-oriented fibers can be bonded by friction, and/or cohesion and/or adhesion as needed to provide the main body. In one embodiment of the invention, a plurality of the first non-oriented fibers can be fixed-length or continuous filaments, or can be formed in sites. Preferably, step (a) is stacking the first non-oriented fibers to provide the main body.

The step (b) according to the invention is stacking or weaving the first oriented fibers and the second oriented fibers to form the pressure distribution sheet. Preferably, the first oriented fibers and the second oriented fibers are woven with each other.

The manner of the step (c) according to the invention of intersecting the first oriented fibers and/or the second oriented fibers with at least one of the first non-oriented fibers can be any. Preferably, the step (c) comprises needle punching the first oriented fibers and/or the second oriented fibers with at least one of the first non-oriented fibers and making the first oriented fibers and/or the second oriented fibers to intersect with at least one of the first non-oriented fibers to provide the pressure distribution sheet.

While embodiments of the present invention have been illustrated and described, various modifications and improvements can be made by persons skilled in the art. The embodiments of the present invention are therefore described in an illustrative but not restrictive sense. It is intended that the present invention is not limited to the particular forms as illustrated, and that all the modifications not departing from the spirit and scope of the present invention are within the scope as defined in the appended claims.

What is claimed is:

1. A polishing pad comprising a polishing sheet and a buffer sheet, wherein the buffer sheet comprises:

a main body comprising a plurality of first non-oriented fibers; and a pressure distribution sheet comprising a plurality of first oriented fibers, a plurality of second oriented fibers and a plurality of second non-oriented fibers, wherein all the first oriented fibers are arranged in a first direction and located on a first plane; all the second oriented fibers are arranged in a second direction and located on a second plane; the first direction intersects with the second direction; the second non-oriented fibers are placed between the first plane and the second plane; the first oriented fibers and/or the second oriented fibers intersect with at least one of the second non-oriented fibers; and the first oriented fibers and/or the second oriented fibers intersect with at least one of the first non-oriented fibers.

2. The polishing pad according to claim 1, wherein the pressure distribution sheet constitutes one surface of the buffer sheet, and the main body constitutes the other surface of the buffer sheet.

3. The polishing pad according claim 1, wherein the main body includes two layers, and the pressure distribution sheet is sandwiched between the two layers of the main body.

4. The polishing pad according claim 1, wherein the first direction is perpendicular to the second direction.

5. The polishing pad according claim 1, wherein each of the first oriented fibers and/or each of the second oriented fibers extends through the buffer sheet in a horizontal direction parallel to a surface of the buffer sheet.

6. The polishing pad according to claim 1, wherein the material of the first non-oriented fibers is different from the materials of the first oriented fibers and/or the second oriented fibers.

7. A polishing apparatus comprising:

a base plate;

a substrate;

the polishing pad, which is adhered on the base plate for polishing the substrate, comprising a polishing sheet and a buffer sheet, wherein the buffer sheet comprises:

a main body comprising a plurality of first non-oriented fibers; and a pressure distribution sheet comprising a plurality of first oriented fibers, a plurality of second oriented fibers and a plurality of second non-oriented fibers, wherein all the first oriented fibers are arranged in a first direction and located on a first plane; all the second oriented fibers are arranged in a second direction and located on a second plane; the first direction intersects with the second direction; the second non-oriented fibers are placed between the first plane and the second plane; the first oriented fibers and/or the second oriented fibers intersect with at least one of the second non-oriented fibers; and the first oriented fibers and/or the second oriented fibers intersect with at least one of the first non-oriented fibers; and a polishing slurry, which is contacting with the substrate for polishing.

8. The polishing apparatus according to claim 7, wherein the pressure distribution sheet constitutes one surface of the buffer sheet, and the main body constitutes the other surface of the buffer sheet.

9. The polishing apparatus according to claim 7, wherein the main body includes two layers, and the pressure distribution sheet is sandwiched between the two layers of the main body.

10. The polishing apparatus according to claim 7, wherein the first direction is perpendicular to the second direction.

11. The polishing apparatus according to claim 7, wherein each of the first oriented fibers and/or each of the second oriented fibers extends through the buffer sheet in a horizontal direction parallel to a surface of the buffer sheet.

12. The polishing apparatus according to claim 7, wherein the material of the first non-oriented fibers is different from the materials of the first oriented fibers and/or the second oriented fibers.

* * * * *